US005645131A

United States Patent [19]

Trevisani

[11] Patent Number: 5,645,131

[45] Date of Patent: Jul. 8, 1997

[54] DEVICE FOR JOINING THREADED RODS AND TUBULAR CASING ELEMENTS FORMING A STRING OF A DRILLING RIG

[75] Inventor: Davide Trevisani, Cesena, Italy

[73] Assignee: Soilmec S.p.a., Cesena, Italy

[21] Appl. No.: 488,613

[22] Filed: Jun. 8, 1995

[30] Foreign Application Priority Data

Jun. 14, 1994 [IT] Italy ..... TO94A0489

[51] Int. Cl.[6] ..... E21B 19/00

[52] U.S. Cl. ..... 175/171; 166/77.52; 166/77.53

[58] Field of Search ..... 175/52, 85, 113, 175/162, 171; 166/77.51, 77.52, 77.53

[56] References Cited

U.S. PATENT DOCUMENTS

| | | | |
|---|---|---|---|
| 4,765,401 | 8/1988 | Boyadjieff | 166/77.53 |
| 4,800,968 | 1/1989 | Shaw et al. | 166/77.52 X |
| 4,813,493 | 3/1989 | Shaw et al. | 166/77.53 X |

*Primary Examiner*—William P. Neuder

*Attorney, Agent, or Firm*—Merchant, Gould, Smith, Edell, Welter & Schmidt, P.A.

[57] ABSTRACT

A device for joining an element to a string of elements already mounted, including threaded rods and tubular casing elements covering the walls of a borehole, for use in drilling equipment including a rotary head driving said string with a combined movement of rotation about a substantially vertical axis and translation along said axis. The device includes a clamping device for clamping and guiding a single element, coupled to a friction screwing device (18). The clamping and guiding device is adapted for holding the single element in an axially aligned position relative to the elements already mounted. The clamping and guiding device is idly mounted to, and suspended from the rotary head. The friction screwing device has a rotating portion and a non-rotating portion. The rotating portion is provided with a lower friction device sliding along and rotating about an output rotary shaft of the rotary head. The non-rotating portion is fast for rotation with the rotary head and has actuators acting on said friction device. When extended, the actuators urge the friction device to engage and rotate the single rod or casing element such that the lower end thereof is screwed to the uppermost element of the string.

8 Claims, 6 Drawing Sheets

DEVICE FOR JOINING THREADED RODS AND TUBULAR CASING ELEMENTS FORMING A STRING OF A DRILLING RIG

DESCRIPTION

1. Field of the Invention

The present invention falls within the field of drilling rigs. More particularly, the invention relates to a device for joining threaded rods and tubular casing elements forming a string of a drilling rig.

2. Background of the Invention

One of the major problems that are encountered in drilling wells concerns the operations of joining the rods and tubular casing elements. Coupling of the rods, which usually have threaded ends, is particularly critical. Coupling must provide axial alignment while exerting a predetermined screwing torque. It is apparent that there are risks involved in using rough or empirical methods of joining and screwing rod strings by using auxiliary inapt lifting means and letting it to the operator's sensibility and experience to control the coupling torque to be applied using mechanical/manual wrench or chain means. Also, it is risky to carry out this operation using the rotary driving head directly.

In this way, incorrect couplings which could damage the threads of the rods or casing elements are likely to occur.

European Patent No. EP-A-0 548 900 discloses a solution providing a driving head moving on an articulated quadrilateral linkage system to facilitate raising of drilling members. U.S. Pat. No. 5,375,667 refers to a stowing and handling system for rods and tubular casing elements used in drilling rigs; this system is adapted for use in combination with the equipment of EP-A-0 548 900.

SUMMARY OF THE INVENTION

It is an object of the present invention to provide a device capable of connecting drilling elements adequately by applying a predetermined and appropriate coupling force to the threaded couplings. It is also an object of the invention to provide a device adapted to work in combination with the apparatuses disclosed in the above cited references.

These and further object and advantages which will be more apparent hereinafter are accomplished according to the invention by the provision of a device for joining an element to a string of elements already mounted including threaded rods and tubular casing elements covering the walls of a borehole, for use in drilling equipment having a rotary head driving said string with a combined movement of rotation about a substantially vertical axis and translation along said axis, the device comprising: clamping and guiding means for clamping and guiding a single element in an axially aligned position relative to the elements already mounted, said clamping and guiding means being idly mounted to the rotary head; friction screwing means operatively coupled to said clamping and guiding means, said friction screwing means comprising a first, rotating portion having a lower friction device mounted to an output rotary shaft of said rotary head for sliding along and rotating with said rotary shaft, and a second, non-rotating portion rotationally locked to the rotary head to rotate therewith, said second, non-rotating portion comprising actuator means acting on said friction device, said actuator means having a first, axially retracted position not interfering with said single element while clamping and transferring said single element and a second, axially extended screwing position in which said friction device engages and rotates said single element such that a lower end of said single element is screwed to an uppermost element of the string.

BRIEF DESCRIPTION OF THE DRAWINGS

In order that the present invention may be well understood there will now be described a preferred embodiment thereof, given by way of example, reference being made to the accompanying drawings, in which.

DETAILED DESCRIPTION OF PREFERRED EMBODIMENTS

Figure 1:
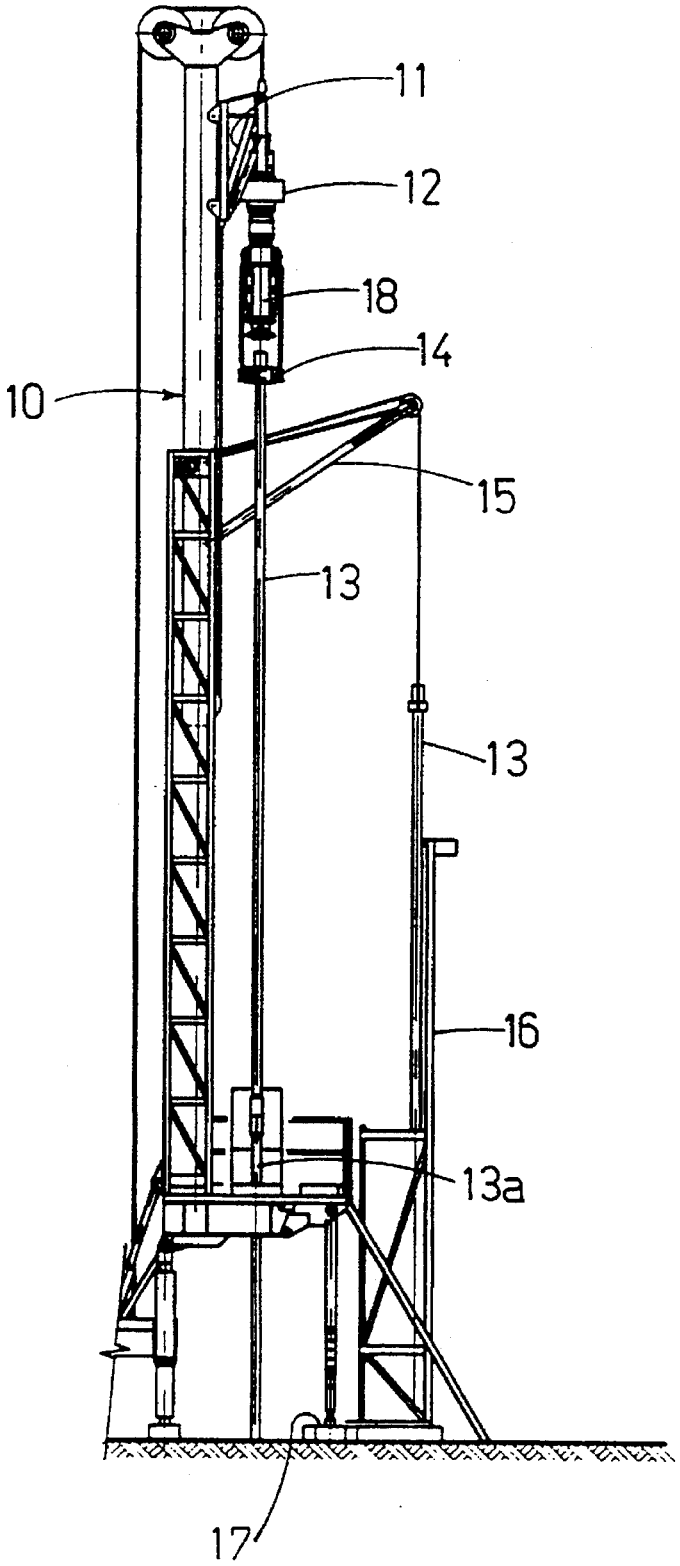
FIG. 1 is an overall view of a drilling rig fitted with the device of the present invention; the drilling rig is depicted in a step of joining and screwing the drilling rods.

With reference initially to FIG. 1, numeral 10 designates a telescopic drilling tower supporting a rotary drilling head 12 through a parallelogram linkage system 11. Rotary drilling head 12 drives drilling rods 13 accomplishing a combined movement of rotation and vertical translation. A jib crane 15 draws the single rods one at a time from a preferably tiltable lattice-like container 16, and puts them in a service hole 17 near the borehole. This sequence is not described in detail, as already known from U.S. Pat. No. 5,375,667. By means of the parallelogram linkage system 11, the rotary head 12 withdraws a rod from the service hole and takes it to the borehole axis to fit it to the rod string already operating.

Figures 2A, 2B:
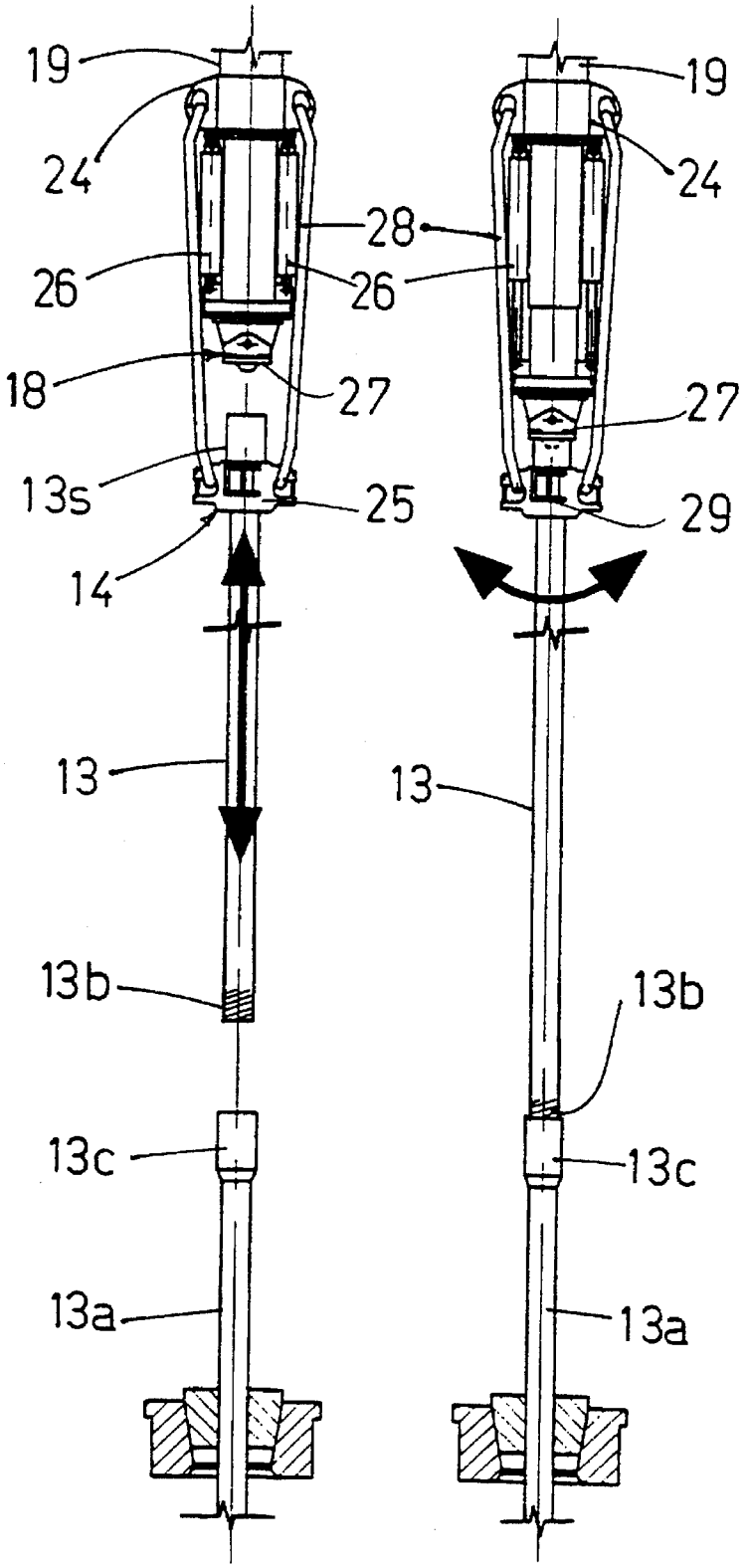
FIG. 2A and 2B depict the sequence of movements of the screwing and joining device while mounting the rod string.
Figure 3:
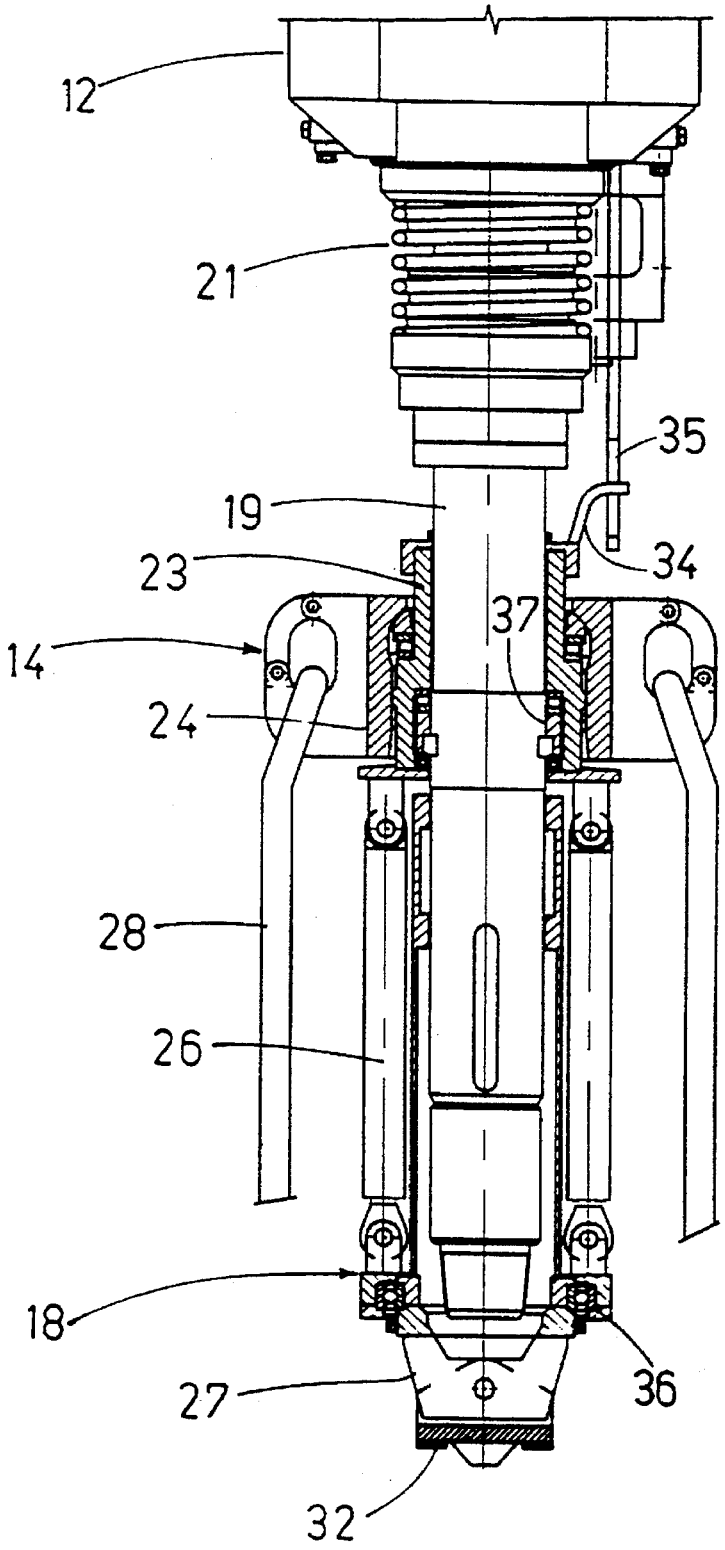
FIG. 3 is a section view to an enlarged scale of a detail of the device of the present invention in the operation position of FIG. 2A.
Figure 4:
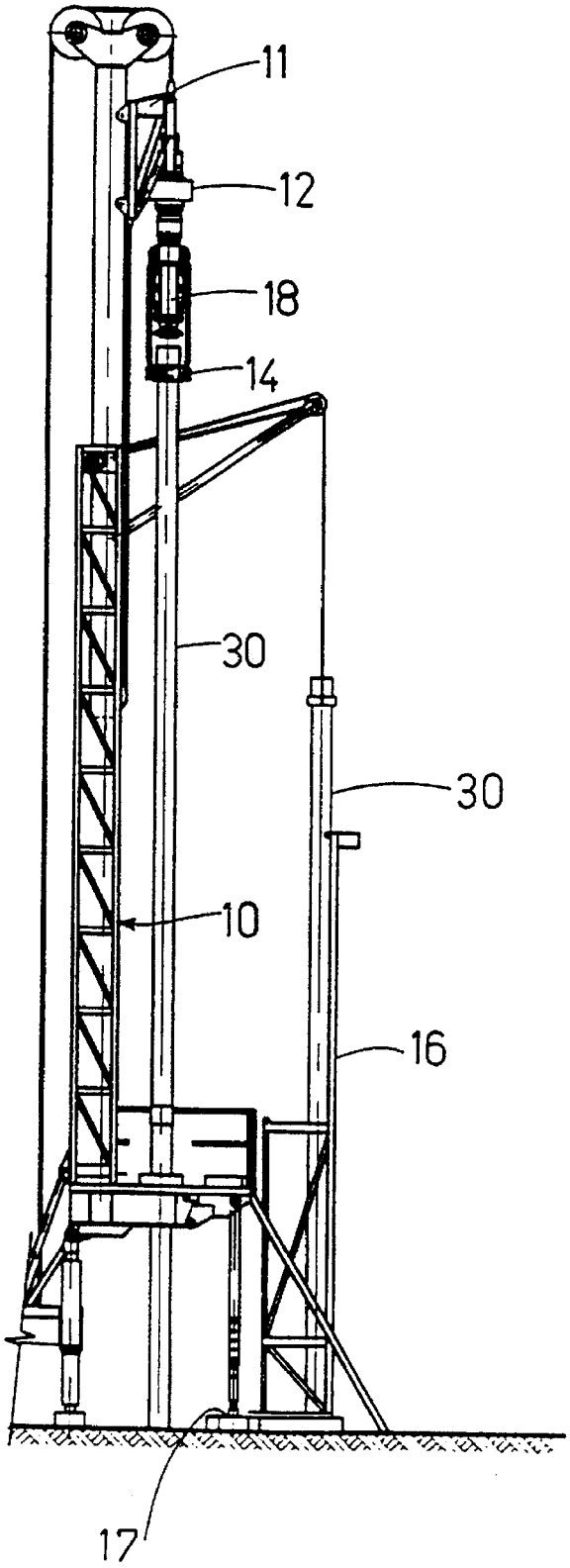
FIG. 4 depicts the whole drilling equipment of FIG. 1 in a sequence of joining and screwing together a series of tubular casing elements.

Referring to FIGS. 2A and 3, according to the present invention, numeral 18 indicates overall a device for joining and screwing the rods. Screwing device 18 is mounted to the rotary output shaft 19 for rotating integral therewith. A rod clamping device 14 is idly mounted to screwing device 18.

A screwing device 18 comprises an upper bushing 23 and a lower disc 27 vertically movable by a plurality of hydraulic rams 26. Upper bushing 23 is vertically slidable along the rotary shaft 19 and held fast for rotation with the rotary head 12 by a radially protruding bracket member 34 that engages a vertical rod 35 in a slidable manner, the vertical rod 35 being integral with the rotary head. This slidable coupling allows the rotary head 12 to drive the upper bushing 23 regardless of the vertical position of the screwing device 18. Lower disc 27 is mounted to a lower bushing or tube 33 which is slidable along shaft 19, but rotatably fast therewith. A bearing 36 is provided between disc 27 and the base to which the lower ends of rams 26 are attached. Rams 26 are fed via a conventional rotating joint feeding device 37 located within the upper bushing 23.

As shown in FIG. 2A, rod clamping device 14 is a conventional device comprising an upper collar 24 idly mounted to upper bushing 23 and rigidly connected to a lower rod clamping and guiding collar 25 by a plurality of longitudinal arms 28. Lower collar 25 is coaxial to upper collar 24 and consists of a substantially cylindrical body the axial length of which is comparable with its inner bore. In the present embodiment there are shown two arms 28, but it is understood that their number and arrangement may differ according to requirements.

Still referring to FIG. 2A, lower collar 25 is fitted with an external manual control 29 for controlling opening and closing of the collar on the rod 13.

In the embodiment shown in the drawings, collar 25 closes mechanically to lock the rod immediately under the upper coupling box 13*c* of greater diameter, such that the rod can be lifted up and held axially due to the contrast between collar 25 and upper coupling box 13*c*.

However, clamping of the rod may also be attained in other ways, for example by replacing the mechanically closing collar 25 with a hydraulic clamp (not shown) or another different kind of collar having an inner surface providing a series of protrusions (wedges or splines) to lock the rod by friction. In the latter case, the axial retaining force the collar exerts on the rod should be set to provide a safe grip while moving the rod.

Coupling of each single rod 13 to the upper element 13*a* of the rod string already operating is as follows. Rotary head 12 is moved via the parallelogram linkage system 11 to a handling location where a new rod 13 has been left by jib crane 15. The new rod 13 is locked in collar 25 proximate to its upper end, leaving part of the upper coupling box 13*s* of the rod extending from above. In this initial position, rams 26 of the screwing device 18 are in a retracted position, whereby disc 27 is above the new rod without contacting it. From the lifted position of FIG. 2A, rotary head 12 is lowered with all its parts attached, until the bottom coupling box 13*b* of the new rod contacts the upper coupling box 13*c* of the last rod mounted to the string. Then, hydraulic rams 26 are extended, driving disc 27 against the upper edge of the upper coupling box of the rod. Within a certain range, the screwing torque will be proportional to the biasing force exerted by the rams.

The reactions of rotary output shaft 19 are dampened by a conventional spring floating system 21 allowing the shaft 19 to elastically accomplish axial movements in a limited range relative to the supporting rotary head 12 (FIG. 3). As rod 13 is screwed down, it draws the whole loading device down with it. This movement of the loading device is made possible by floating system 21 having at least a lower spring 21 and an upper spring (not shown) located above rotary head 12.

Screwing torque is transmitted to rod 13 by friction through a wear element 32 of high friction material fitted on the lower face of disc 27. During screwing, rod clamping and guiding device 14 rotates with the rod being screwed. Upon reaching the predetermined screwing torque, rod 13 and device 14 stop rotating.

At this point coupling is attained. Movement of rotary head and screwing device 18 is stopped. Rod 13 is released from clamping device 14 by acting on manual control 29. The clamping device 14 and lower disc 27 are removed. Then, rod 13 may be screwed directly to shaft 19 to proceed in drilling a length of bore corresponding to the length of the rod mounted last.

As is apparent from FIGS. 1 to 3, particularly from the arrows shown in FIG. 2, the method is adapted also for unscrewing and disassembling the rod string. In this case operations are reversed with respect to what discussed herein above.

In case a collar 25 is chosen for retaining the rod by friction, coupling operation will differ from the above described sequence. In this case, the new rod is locked well underneath of its upper coupling box 13*c*. Rotary head is lowered far enough to move the bottom coupling box 13*b* near to collar 13*c* of the rod mounted last, but without contacting it. Rams 26 urge the new rod downwards, making it slide in collar 25 until it engages collar 13*c*. In moving downwards, rod 13 is appropriately guided axially by collar 25 itself. Grasping of collar 25 will have to be calculated in order that the axial force retaining the rod is relatively low, to be easily overcome by the thrust of disc 27 without damaging the side wall of the rod. However, such a grasping force will have to be sufficient to prevent the rod from coming loose and falling due to its weight while it is lifted up and moved.

Referring now to FIGS. 4, 5A, 5B and 6, wherein like numerals designate like parts, similar operations are shown relative to tubular casing elements 30. The jib crane 15 draws a tubular casing element 30 and leaves it on a service hole 17. Rotary head 12 takes the tubular casing element above the borehole to screw it to the tubular casing element underneath. As discussed for the rods, also tubular casing element 30 is handled by an appropriate clamping and guiding device 14 having a collar 25 supported by arms 28. The operational sequence are not herein repeated, being similar to that of the rods. The only relevant differences worth pointing out concern the disc 27 and friction wear element 32, which will be obviously different, as well as collar 25.

Figures 5A, 5B:
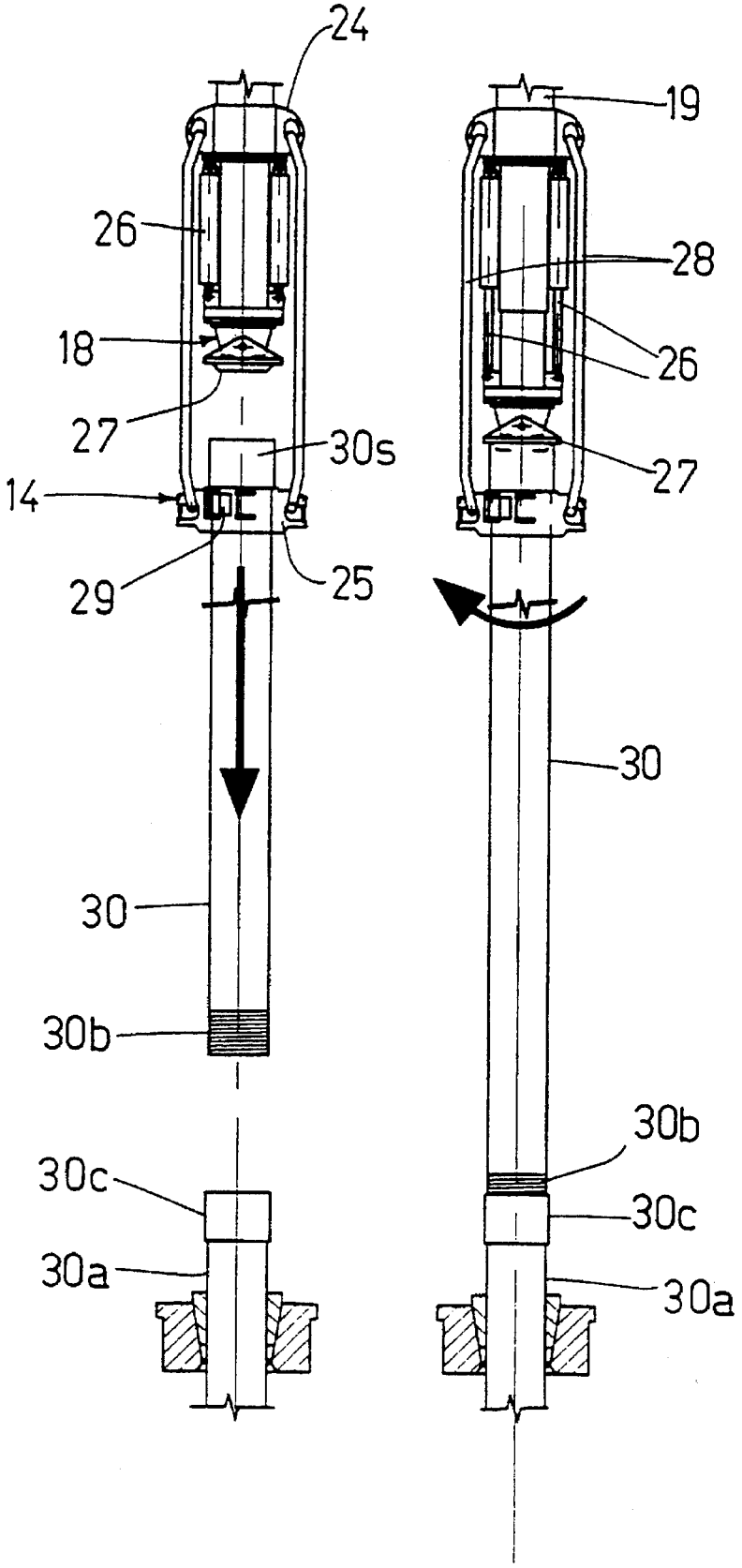
FIGS. 5A and 5B show a sequence of movements of the device of the invention screwing and joining the tubular elements.
Figure 6:
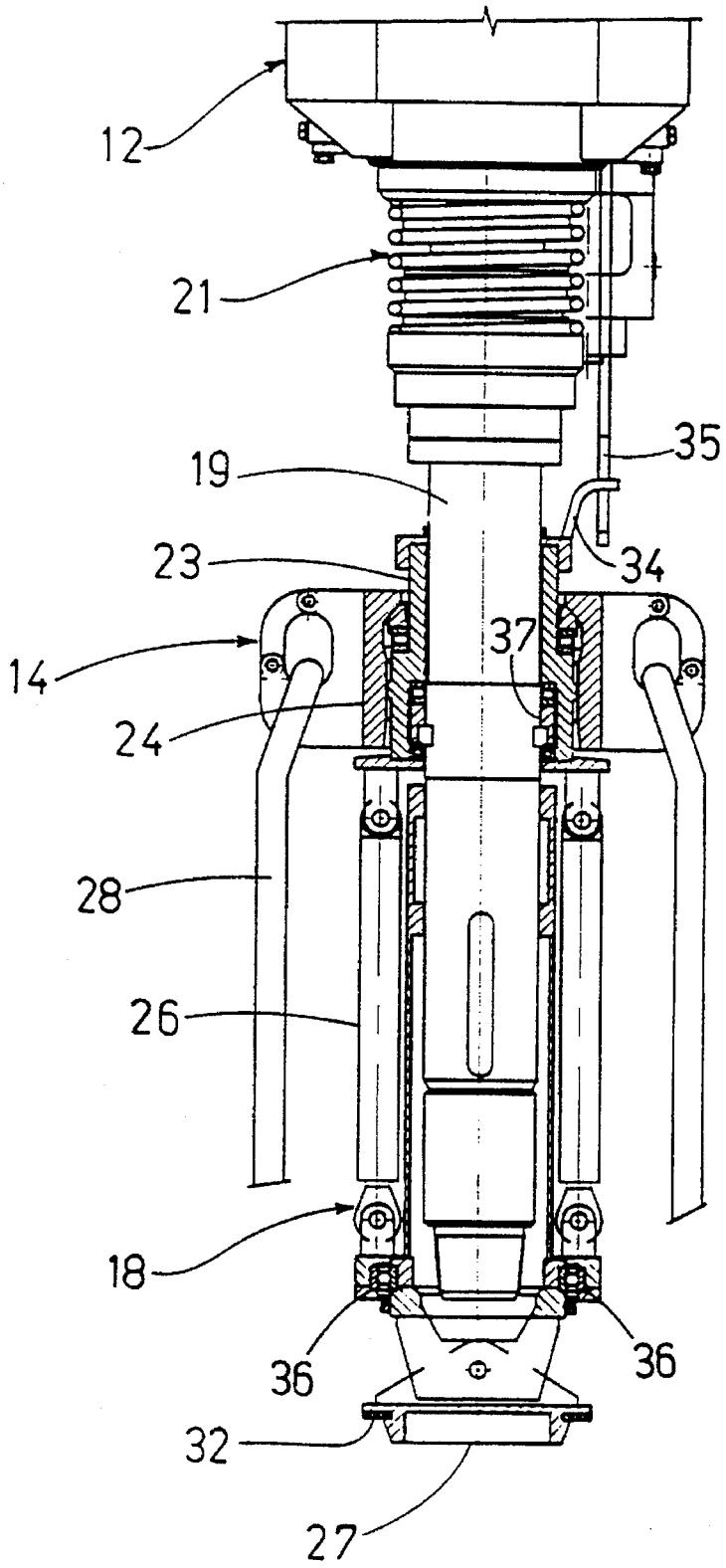
FIG. 6 is a detailed view of the device of FIG. 4.

A further difference is that rotational movement of head 12 will have to be in one direction only, i.e. in the screwing and downward direction shown by the arrows in FIGS. 5A and 5B, as the tubular casing element is permanently left in the borehole.

It will be appreciated that the present invention, besides providing the main advantage of a correct, safe and almost automatic sequence of joining a rod string and a tubular casing element string, there is also an advantage in using a single device both for the rods and the tubular casing elements, it being sufficient to replace very few elements in passing from drilling operations to those of fitting the tubular casing elements.

I claim:

1. A device for joining an element to a string of elements already mounted, including threaded rods and tubular casing elements covering walls of a borehole, for use in drilling equipment having a rotary head driving said string with a combined movement of rotation about a substantially vertical axis and translation along said axis, said device comprising:

clamping and guiding means for clamping and guiding a single element in an axially aligned position relative to the elements already mounted, said clamping and guiding means being idly mounted to the rotary head;

friction screwing means operatively coupled to said clamping and guiding means, said friction screwing means comprising a first, rotating portion having a lower friction device mounted to an output rotary shaft of said rotary head for sliding along and rotating with said rotary shaft, and a second, non-rotating portion rotationally locked to the rotary head to rotate therewith, said second, non-rotating portion comprising actuator means acting on said friction device, said actuator means having a first, axially retracted position not interfering with said single element while clamping and transferring said single element and a second, axially extended screwing position in which said friction device engages and rotates said single element such that a lower end of said single element is screwed to an uppermost element of the string.

2. The device of claim 1, wherein said first, rotating portion of said friction screwing means comprises an upper bushing rotatably mounted on said shaft, and said second non-rotating portion of said friction screwing means comprises a lower bushing mounted rotatably fast with said shaft.

3. The device of claim 2, wherein said actuator means are hydraulic means fed through a rotating joint feeding device located within said upper bushing.

4. The device of claim 1, wherein said clamping and guiding means comprises an upper collar idly mounted relative to said rotary head, said upper collar being rigidly connected by a plurality of longitudinal arms to a lower collar for clamping and guiding said single element.

5. The device of claim 4, wherein said upper collar is idly mounted to said upper bushing.

6. The device of claim 4, wherein said lower collar is a body of cylindrical shape having an axial length sufficient to guide appropriately axial movement of said single element under axial thrust generated by said actuator means (26).

7. The device of claim 6, wherein said lower collar is adapted to retain said single element by friction in a plurality of positions axially aligned with the string of elements already mounted, said lower collar acting on said single element with a predetermined axial force sufficient to support the single element under dead load of the single member itself without slipping, said predetermined axial force being less than the axial thrust exerted by said actuator means.

8. The device of claim 6, wherein said lower collar has an axial length substantially equal to its inner bore.

* * * * *